United States Patent [19]

Lieding

[11] 4,234,125

[45] Nov. 18, 1980

[54] POP-UP SPRINKLER

[75] Inventor: Calvin A. Lieding, Glendora, Calif.

[73] Assignee: Irrigation Specialties Company, San Gabriel, Calif.

[21] Appl. No.: 85,807

[22] Filed: Oct. 17, 1979

[51] Int. Cl.[3] ..... B05B 15/02; B05B 15/10

[52] U.S. Cl. ..... 239/111; 239/205

[58] Field of Search ..... 239/104, 106, 108–113, 239/203–206

[56] References Cited

U.S. PATENT DOCUMENTS

| | | | |
|---|---|---|---|
| 3,268,173 | 8/1966 | Costa | 239/206 |
| 3,335,959 | 8/1967 | Lockwood | 239/204 |
| 3,921,910 | 11/1975 | Hayes et al. | 239/205 |
| 4,078,726 | 3/1978 | Walto | 239/205 |

*Primary Examiner*—Robert W. Saifer

*Attorney, Agent, or Firm*—Christie, Parker & Hale

[57] ABSTRACT

A long-extension pop-up sprinkler for subsurface installation and irrigation of overlying plantings. A wiper seal or ring at the top of the sprinkler body strips sand and dirt from a riser which retracts when inlet water is turned off, and this seal is water flushed during both extension and retraction of the riser. An internal moving seal at the bottom of the riser isolates the wiper ring from line-pressure water, and enables flushing of the ring during both riser extension and retraction by water trapped within the sprinkler body.

10 Claims, 10 Drawing Figures

POP-UP SPRINKLER

BACKGROUND OF THE INVENTION

Pop-up sprinklers in a variety of styles have for many years been used to irrigate ground-cover plantings. Sprinklers of this type have a nozzle or spray head mounted at the upper end of a riser which is movably mounted on a housing or sprinkler body buried in the ground and connected to a subsurface water line. When the water is turned on, the riser elevates to position the head above surrounding plantings to insure proper distribution of the irrigation water.

Pop-up sprinklers are advantageous in that the riser and head are retracted to the soil level when watering is not taking place. This low-profile aspect of the sprinkler makes the sprinkler essentially invisible beneath the overlying planting to minimize the risk of sprinkler-head theft or other vandalism, and the possibility of passerbys striking or tripping on the head, these problems being common with sprinkler heads mounted on fixed nipples of six to twelve inch height.

Most prior-art sprinklers, however, have used a relatively small elevation (perhaps a few inches) of the head, and those designs with larger elevation capabilities have been unreliable due to jamming or clogging of the riser caused by ingested dirt or sand within the sprinkler. This problem is particularly acute in sprinklers which use line pressure to flush the housing interior during riser movement, because jamming of or interference with the riser at an intermediate position results in flooding of the area around the sprinkler when the flush water flows at line pressure around the outside of the riser.

The sprinkler of this invention provides excellent elevation (typically about 12 inches) of the head above the retracted position, and minimizes the risk of jamming by a novel cup seal arrangement and riser wiper system. Importantly, the use of line-pressure water is avoided for internal flushing during riser movement, and flushing can instead be done with static water which is trapped in a cavity within the sprinkler. The new sprinkler is also fitted with a relatively high side inlet to eliminate the need for deep burial of the water supply line, and the inlet is fitted with a rotatable union nut which enables quick and simple connection of the sprinkler to the supply line without rotation of the entire sprinkler assembly. Burial of the side-entry inlet connection has the added advantage of preventing theft by a simple unscrewing manipulation at the surface.

SUMMARY OF THE INVENTION

This invention relates to a pop-up sprinkler having a riser movably mounted in a bore of a stationary housing, the housing being adapted for connection to a water line, and having an inlet passage leading to the bottom of the bore beneath the riser. A flow passage extends between upper and lower ends of the riser, and the upper end is adapted to receive a sprinkler head or nozzle. The riser makes a loose fit in the bore so there is a space or annulus between the outer surface of the riser and the inner housing surface or wall which defines the bore. A cup seal is mounted adjacent the lower end of the riser, and the cup seal has a depending skirt which is in sliding and sealing contact with the surrounding wall of the housing. A resilient means such as a coil spring is connected between the housing and riser to urge the riser into the housing to retract the sprinkler head.

Line-pressure water flowing into the sprinkler acts against the undersurface of the riser and cup seal to drive the riser as a piston upwardly in the bore until a stop on the housing limits further riser movement. In this position, the sprinkler head is positioned above surrounding vegetation, and normal irrigation watering is completed. When the flow of line pressure water is terminated, the resilient means retracts the riser back into the housing. The cup seal is operative during normal flow of line-pressure water to prevent entry of such water into the annulus above the seal, and undesired flow of line-pressure water from the top of the housing is prevented. A wiper ring is fitted at the top of the housing to wipe debris from the riser as it retracts into lowered position.

Preferably, the cup seal is movably mounted at the lower part of the riser to cooperate with a fixed O-ring seal in sealing a flow path between the outside of the riser and the inside of the cup seal. A spring or equivalent resilient device urges the cup seal against the O-ring seal when the riser is moving toward the elevated position and while normal sprinkling takes place. The contact of the two seals is broken after flow of line-pressure water is terminated and while the riser moves toward the retracted position. The opening of this flow path admits static water from the housing below the riser into the relatively small volume of the annulus to enable flushing of the wiper ring and adjacent surfaces during riser extension and retraction. Leakage of line-pressure water, however, is prevented by the seals. Preferably, the riser has a relatively long extension of about twelve inches, and the housing includes a side inlet connection with a freely rotatable union nut for coupling to a water line.

DESCRIPTION OF THE PREFERRED EMBODIMENT

Figure 1:
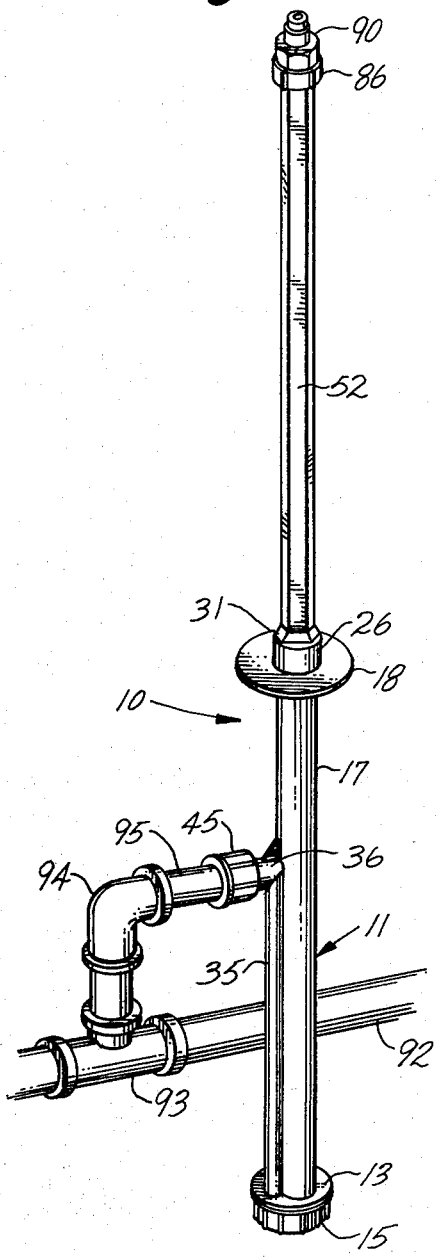
FIG. 1 is a pictorial view of the sprinkler of this invention, shown as connected to a subsurface water supply line, and with a riser and sprinkler head in an elevated position.
Figure 2:
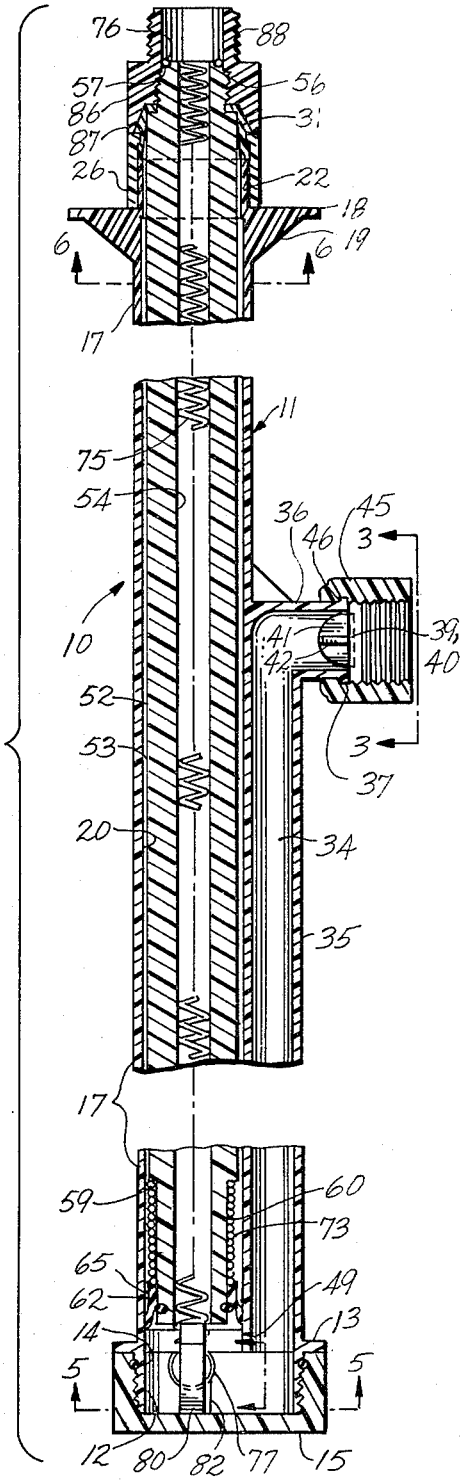
FIG. 2 is a sectional elevation of portions of the sprinkler with the riser retracted.
Figure 4:
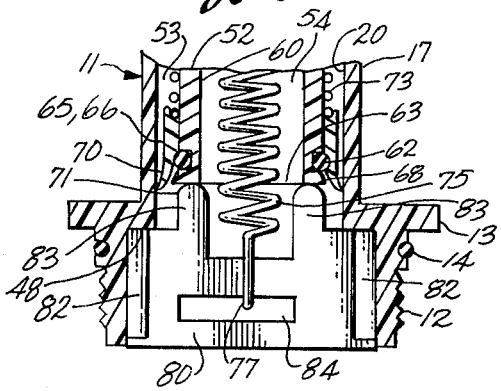
FIG. 4 is a view on line 4—4 of FIG. 2 with a lower cap removed.

Referring to FIGS. 1, 2 and 4, a pop-up sprinkler 10 according to the invention includes a generally tubular body or housing 11 having an externally threaded lower end 12. An outwardly extending flange 13 projects from the housing just above the externally threaded lower end, and a conventional O-ring seal 14 is seated in a groove beneath the flange and above the upper end of the threaded portion. A removable lower cap 15 is threaded over lower end 12 against flange 13 to close the bottom of the sprinkler housing, and to effect a water-tight seal by compressing seal 14.

Figure 6:
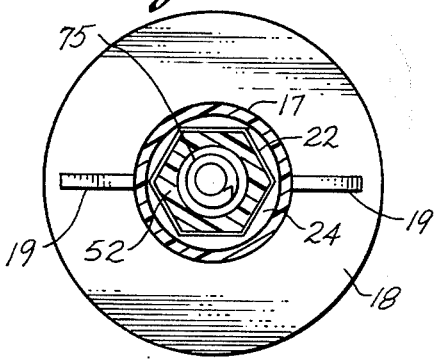
FIG. 6 is a view on line 6—6 of FIG. 2.

The main body of housing 11 above flange 13 is formed as a hollow tube 17 which extends upwardly to an upper flange 18 which is reinforced by a pair of integrally formed gussets 19 (FIGS. 1, 2 and 6). The inner surface of tube 17 defines a generally cylindrical bore 20 which is preferably very slightly tapered to decrease in diameter toward the upper end of the tube. An overall taper of about 0.015 inch is satisfactory, and, in a typical unit, the inside diameter of the bore is about 0.887 inch at the lower end, and about 0.872 inch at the upper end.

An upper end 22 (FIGS. 2, 6 and 9–10) of housing 11 is formed substantially as a short tubular extension of tube 17 above upper flange 18. The inner surface of the upper end, however, differs from the generally cylindrical (though slightly tapering) bore of tube 17 in two respects. First, the lower end of the inner surface of the upper end is extended radially inward to form a downwardly facing shoulder 24. Second, the hollow interior of the upper end is non-circular in cross section, and is preferably formed to be hexagonal in shape as shown in FIG. 6.

An upper cap 26 (FIGS. 2, 7 and 9, 10) has a cylindrical skirt 27 which makes a snug interference fit over upper end 22 of the sprinkler housing. A top wall 28 of the upper cap extends radially inwardly from the cap skirt to define a hexagonal opening 29. Although the upper cap may be threaded on the sprinkler housing, preferably the cap is cemented or sonic welded in place against upper end 22 and flange 18 as there is normally no need to remove this part should cleaning or servicing of the sprinkler become necessary.

Figure 7:
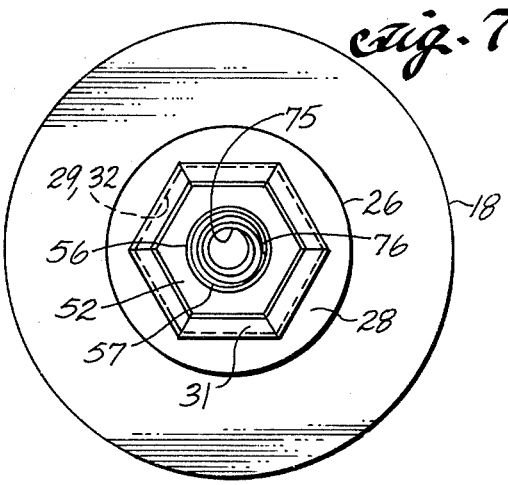
FIG. 7 is a top view of the upper end of the sprinkler with a riser cap removed to show the riser and a wiper ring.
Figure 8:
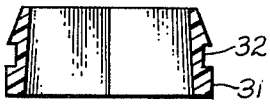
FIG. 8 is a sectional elevation of the wiper ring.
Figure 9:
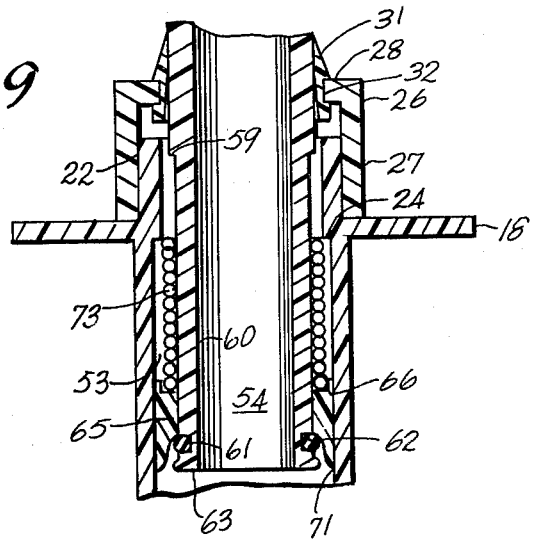
FIG. 9 is a sectional view showing an upper portion of the sprinkler with the riser in a fully elevated position.

An integrally molded wiper ring 31 (FIGS. 7–9) is fitted into the upper end of upper cap 26, and the inner surface of the ring has an upwardly tapered hexagonal cross section. An annular groove 32 is formed in the outer surface of the wiper ring, and the floor of this groove, as well as the outer surface of the ring above the groove, is hexagonal in cross section. The wiper ring makes an interference fit within the upper cap, and top wall 28 of the cap fits snugly in groove 32 of the ring as shown in FIGS. 7 and 9. The outer surface of the ring below groove 32 is generally cylindrical to make a snug fit against the inner surface of upper cap 26 below top wall 28.

A water inlet passage 34 is defined by an integrally molded sidewall 35 which has a generally semi-circular cross section (FIGS. 1–2 and 5), and which extends radially from one side of tubular housing 11 from lower flange 13 to a position approximately midway along the length of the sprinkler housing. The upper end of sidewall 35 extends laterally from housing 11 to define a cylindrical inlet tube 36 having a radially enlarged annular rib 37 at its outer end.

Figure 3:
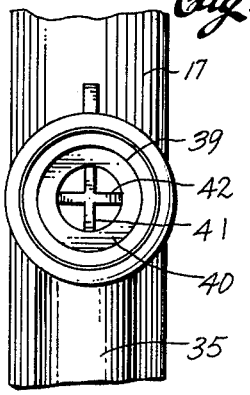
FIG. 3 is a view on line 3—3 of FIG. 2.

A combination rock guard and pipe-connection seal 39 is fitted into inlet tube 36 as shown in FIGS. 2–3. The seal is formed as a cylindrical hollow ring 40 which fits against the outer end of annular rib 37. Extending across the hollow interior of the ring are a pair of interconnected walls 41 and 42 which, when viewed from the side as shown in FIG. 2, are generally semi-circular in shape. A clear passage for inlet water is defined by the spaces between walls 41 and 42 as shown in FIG. 3, but the walls serve to trap any pebbles or large debris entrained in the inlet water.

An internally threaded union nut 45 (FIGS. 1–3) is force fitted over the end of inlet tube 36, and has an inner surface defining an annular groove 46 which receives annular rib 37 to retain the union nut captively on the inlet tube. When thus fitted, the union nut makes a slip fit on the inlet tube so the nut can be freely rotated to connect the sprinkler to the externally threaded end of a water supply line.

Figure 5:
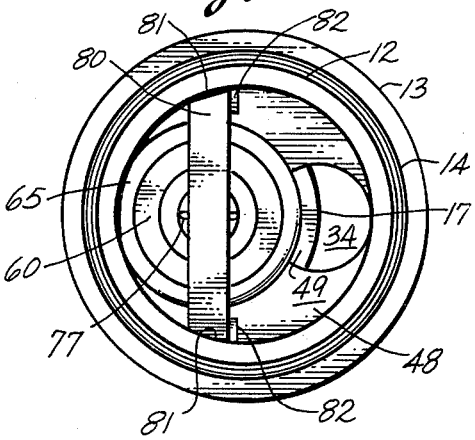
FIG. 5 is a view on line 5—5 of FIG. 2.

As best seen in FIGS. 4 and 5, the top of lower end 12 of the sprinkler housing is defined by the undersurface of lower flange 13 which extends radially inwardly to the edges of bore 20 and the lower end of water inlet passage 34. The undersurface of this internal portion of the lower flange thus forms a downwardly facing shoulder 48. Inlet water can flow freely through the lower end of inlet passage 34 into bore 20 through the space within lower end 12 of the housing as closed by lower cap 15. A notch 49 (FIGS. 2 and 5) is also formed in that portion of the lower end of tube 17 which separates the inlet passage from the housing bore, the purpose of the notch being to reduce further the impedance to free flow of inlet water into the sprinkler.

A hollow tubular riser 52 makes a loose slip fit within bore 20 of the sprinkler housing to define an annular space or annulus 53 between the outer surface of the riser and the inner surface of the housing. A central and generally cylindrical bore 54 extends between the ends of the riser. The outer surface of the riser is non-circular in cross section, and, in a preferred form, is hexagonally shaped to make a loose slip fit through hexagonal opening 29 in upper cap 26.

The top of the riser is reduced in cross section to form a generally cylindrical and external threaded upper end 56 (FIGS 2 and 7). The riser is further reduced in cross section above the threaded portion of the upper end to define an upwardly facing shoulder 57.

The bottom of the riser is similarly reduced in cross section to define a downwardly facing shoulder 59 from which extends a cylindrical lower end 60 (FIGS. 2, 4 and 9–10). An annular groove 61 is formed adjacent the tip of lower end 60, and an O-ring seal 62 is seated in the groove. The tip of lower end 60 below the O-ring seal is slightly enlarged in diameter to form an annular rib 63.

A flexible and resilient cup seal 65 (FIGS. 4 and 9–10) is force fitted over rib 63 at the lower end of the riser to make a loose slip fit over cylindrical lower end 60 above the O-ring seal. The upper part of the cup seal is formed as a cylindrical ring 66 having an inside diameter which is sufficiently larger than the outside diameter of lower end 60 that a water leakage path exists between these components. A difference of about 0.020 to 0.030 inch between the outside diameter of the riser and the inside diameter of the cup seal provides an adequate leakage path. The top surface of the cup seal is recessed to define an annular groove 67 (FIG. 10), the radially outer part of which is bounded by an upstanding annular rib 68.

An outwardly and downwardly flared skirt 70 extends below ring 66 of the cup seal, and the skirt is downwardly tapered in cross section to a thin cylindrical lip 71. The outside diameter of lip 71 is slightly larger than the diameter of bore 20 in the sprinkler housing, whereby the lip is in sealing contact with the wall of the bore when the riser is fitted within the housing.

A compression coil spring 73 fits loosely over cylindrical lower end 60 of the riser, and the spring has close-wound upper and lower ends, and spaced-apart turns between these ends. The upper end of the spring abuts shoulder 59 at the top of lower end 60 of the riser, (FIG. 10), and the bottom of the spring seats in groove 67 in the top of cup seal 65. The spring is thus captive on the lower end of the riser, but it permits upward movement of the cup seal away from the O-ring seal until the spring is fully compressed or bottomed.

A close-wound riser return spring 75 makes a loose slip fit within bore 54 of the riser, and the spring is sufficiently tensioned to extend between the upper and lower ends of the riser. Several turns 76 at the top of the spring are enlarged in diameter to seat against shoulder 57 at the upper end of the riser (FIGS. 2 and 7). The bottom of the spring defines a downwardly extending hook 77.

A return-spring keeper 80 has beveled ends 81 to fit snugly within lower end 12 of the sprinkler housing as shown in FIG. 5. Lateral movement of the keeper is prevented by a pair of radially inwardly extending ribs 82 which are integrally formed on the inner surface of the housing lower end, and upward movement of the riser is limited by shoulder 48 (FIG. 4). A pair of posts 83 extend upwardly from the top of the keeper, and the posts are spaced apart so the post tips abut the undersurface of annular rib 68 on the bottom of the riser. An opening 84 extends through the central body of the keeper, and hook 77 extends through this opening to secure the bottom of the riser return spring to the keeper.

When the riser assembly is fitted within the sprinkler housing with the spring keeper seated in the lower end of the housing between shoulder 48 and the inner surface of lower cap 15 as shown in FIG. 2, posts 83 limit downward movement of the riser to insure that threaded upper end 56 of the riser extends above the top of wiper ring 31. A riser cap 86 (FIGS. 1–2) is internally threaded to fit over and be secured to the exposed threaded upper end of the riser. A depending skirt 87 is internally outwardly tapered to provide clearance between the skirt and the outer surface of wiper ring 31.

The upper end of the riser cap defines a tubular extension 88 which is externally threaded to receive a conventional sprinkler head 90. The riser cap thus serves as an adapter to enable fitting of a spray head to the sprinkler, and also as a further stop to limit downward or retraction movement of the riser when the lower end of skirt 87 abuts the top of upper cap 26 on the housing.

Housing 11, lower cap 15, upper cap 26, union nut 45, riser 52, keeper 80 and riser cap 86 are preferably molded from an acetal plastic material such as sold under the trademarks Delrin or Celcon. These materials are stable and strong, and resist accumulation of minerals or other materials which may be in the irrigation water which flows through the sprinkler. The coil springs used in the sprinkler are preferably made of stainless steel and sprinkler 90 is conventionally of brass construction. Wiper ring 31, rock guard 39, and cup seal 65 are preferably molded from a material such as polyurethane plastic.

In assembling the sprinkler, the main housing is first prepared by force fitting union nut 45 over the end of inlet tube 36, and securing upper cap 26 (into which wiper ring 31 has been fitted) to the top of the housing. O-ring seal 14 is then fitted over the lower end of the housing, and seal 39 installed within the union nut against inlet tube 36 to complete the housing assembly.

Coil spring 73 is fitted over the lower end of the riser, and O-ring seal 62 is snapped into groove 61. Cup seal 65 is then slipped over the end of the riser and the O-ring seal to seat against the lower end of the spring as already described.

The riser assembly is completed by fitting return spring 75 through the upper end of the riser until enlarged turns 76 seat on the upper end of the riser. A slender tool is then inserted through the lower end of the riser to capture hook 77, enabling the return spring to be extended so the hook can be engaged through opening 84 in the return-spring keeper.

The riser assembly is then inserted through the lower end of the housing until the return-spring keeper seats in the bottom of the housing as already described. Lower cap 15 is then threaded in place to close the lower end of the housing, and the riser cap 86 is also threaded in place as described above. Installation of sprinkler head 90 completes the assembly of the pop-up sprinkler unit. The mating non-circular cross sections of the riser and opening 29 in the upper cap prevent rotation of the riser as these parts are threaded in place.

A typical installation of the sprinkler assembly is shown in FIG. 1. A sub-surface water-supply line 92 has a "T" connection 93 and an elbow 94 connected to an outlet pipe 95 having an externally threaded end. A hole is prepared where the sprinkler is to be positioned, and the depth of the hole is selected so upper flange 18 will rest on the surface or slightly below the surface of the ground to be irrigated. With the sprinkler in this position, union nut 45 is simply rotated to engage the sprinkler with the threaded end of outlet pipe 95. The hole is then filled in around the sprinkler so only the upper end of the assembly is visible.

When the main water-supply valve (not shown) is open, water flows into the sprinkler through inlet tube 36 against the under surface of cup seal 65 and riser 52, and also into bore 54 of the riser to be emitted through sprinkler head 90. The pressure of the inlet water exerted against the under side of the riser and cup seal, combined with the flow impedance presented by the sprinkler head, is sufficient to drive the riser upwardly to a fully extended position (FIG. 1) until the top of coil spring 73 seats against shoulder 24, and the spring is fully compressed to urge the inner surface of the cup seal into tight sealing engagement with O-ring seal 62 (FIG. 9).

It is important to note that the pressure of the incoming water also urges the skirt of the cup seal outwardly into tight sealing engagement with the bore of the sprinkler housing, this action taking place both during erection of the riser, and when the riser is in a fully extended position. Line-pressure water is thus isolated from annulus 53 around the riser, and uncontrolled leakage flow will not occur should the riser for some reason become stuck in an intermediate position.

When the riser is fully extended, the compression of spring 73 forms an even tighter seal between O-ring seal 62 and the inner surface of the cup seal, preventing any dribbling flow through the upper end of the sprinkler, and confining flow of line-pressure water to the bore of the riser to be emitted through the sprinkler head.

Figure 10:
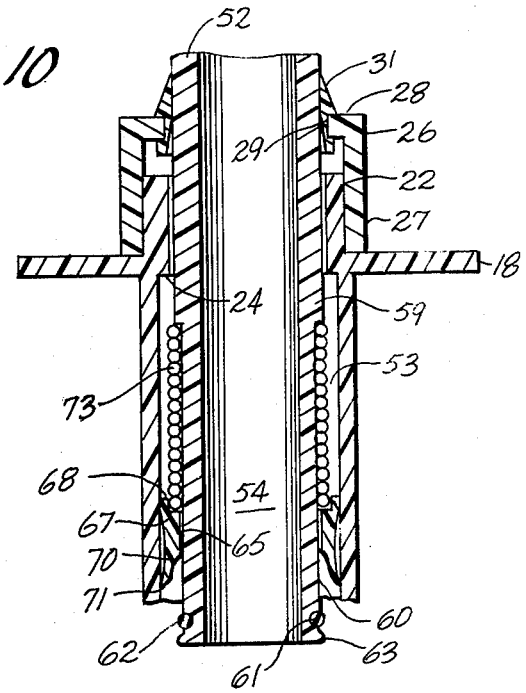
FIG. 10 is a view similar to FIG. 9, but showing the riser after it has started to move downwardly toward the retracted position.

When the flow of water to the sprinkler is turned off at the supply-line valve, return spring 75 (and the restoring force exerted by compressed spring 73) begins to retract the riser back into the housing. The downward movement of the riser and cup seal 65 against the column of static water in bore 20 of the housing below the riser, coupled with the frictional drag of cup-seal lip 71 against the inner surface of tube 17, cause the cup seal to lift away from O-ring seal 62 as shown in FIG. 10. This opens a flow path around seal 62 and through the annular clearance space between the outer surface of cylindrical lower end 60 of the riser and the central opening through ring 66 of the cup seal. The static water is thus driven into annulus 53 as the riser proceeds through the retraction cycle.

When sufficient downward movement of the riser has occurred to fill the annulus, water begins to flow out of the upper end of the housing between the riser and wiper ring 31. The outward flow of water is adequate to clean the top of the housing and resist ingress of mud, sand or dirt as the riser retracts, but the wiper ring remains effective in scraping off any debris which may have collected on the exposed outer surface of the riser during the watering cycle. The opening of a water flow path into the annulus is thus effective in providing positive flushing of the wiper ring and riser during retraction, and in serving as a "vacuum breaker" to prevent the descending riser from sucking debris into the sprinkler body.

As the riser approaches the fully retracted position, coil spring 73 forces the cup seal back into a "closed" position against O-ring seal 62 to trap a pool of static water in annulus 53. When the next watering cycle is initiated, this static water is ejected from the top of the housing between the riser and wiper ring as the riser ascends. Positive flushing of the top of the housing is thus performed at both the beginning and end of a watering cycle, but the flushing is done with trapped static water rather than line-pressure water.

The cup seal is thus operative as both a seal and a valve. The sealing function occurs whenever line pressure water flows through the sprinkler, and it prevents flow of this water into annulus 53 which would flood the surface area around the sprinkler should the riser for any reason be prevented from reaching its fully elevated position. The valving function occurs during riser retraction to enable flooding of annulus 53 with static water, thus enabling positive flushing of debris from the riser and the top of the housing during both upward and downward movement of the riser.

In a typical sprinkler made in accordance with the above description, a riser movement of twelve inches is provided between the retracted and fully elevated positions. This unusually large elevational travel enables the sprinkler head to be lifted above relatively high growths of ground cover for efficient irrigation. Deep trenching of the water supply lines is unnecessary, however, due to the raised position of the inlet tube with respect to the bottom of the housing, and easy installation is provided by the rotational freedom of union nut 45 on the inlet tube.

In the typical sprinkler just described, the riser return spring was selected to provide a restoring force of about 2.7 pounds with the riser retracted and about 6.0 pounds with the riser fully extended. A water pressure of 10 to 15 psi is adequate to drive the riser to the fully elevated position against the restoring force exerted by the return spring. Coil spring 73 is selected to exert a restoring force of about 1.1 pounds in the extended position (with the cup seal driven against O-ring seal 62), and about 1.7 pounds when fully compressed.

Although other types of valving seals may be used, a cup seal is preferred due to its natural action in providing different degrees of frictional drag during upward and downward movement of the riser. Due to the shape of the cup seal, the frictional drag during downward riser movement is slightly higher than during upward movement, thus assisting in lifting the cup seal out of contact with O-ring seal 62 during riser retraction. The cup seal is also very effective in blocking flow of line-pressure water into the annulus, and an increase in water pressure urges the seal even more tightly against the wall of the housing bore.

In irrigation situations where the line water is so extraordinarily dirty and laden with debris that the risk of jamming moving parts with large particulates is too high to permit use of a moving seal and valve arrangement, the cup seal may be rigidly secured to the lower end of the riser. In such a situation, the cup seal is locked to the riser, and is positioned to open a port into inlet passage 34 when the riser is fully retracted, thus permitting flow of static water into annulus 53 to enable the flushing action described above during the next elevational movement of the riser.

I claim:

1. An irrigation sprinkler, comprising:

a housing having a water inlet passage and an internal wall defining an elongated upright bore connected to the inlet passage;

a riser having upper and lower ends, and a flow passage extending between the ends, the upper end being adapted to receive a sprinkler head, the riser being fitted in the bore to be movable between extended and retracted positions;

resilient means connected between the housing and riser for urging the riser into the retracted position;

seal means mounted adjacent the lower end of the riser for slidably sealing the riser to the internal wall so line-pressure water introduced to the inlet passage and flowing into the bore beneath the riser to elevate the riser is prevented from flowing into an annulus above the seal means and between the riser and the internal wall, the seal means being further configured to open a flow path for static water beneath the riser to flow into the annulus during riser retraction when flow of line-pressure water into the sprinkler is terminated.

2. The sprinkler defined in claim 1, and further comprising a wiper means mounted on the housing around the riser for wiping debris from the riser as it moves from the extended position to the retracted position.

3. The sprinkler defined in claim 2, wherein the seal means comprises a cup seal slidably mounted on the riser to be movable toward and away from the riser lower end, a second seal secured in a fixed position on the riser below the cup seal, and a spring disposed on the riser and operative to urge the cup seal into sealing engagement with the second seal to prevent leakage between the riser and cup seal when line-pressure water flows through the sprinkler, the spring enabling the cup seal to separate from the second seal when the riser moves from the extended position to the retracted position.

4. The sprinkler defined in claim 3, wherein the cup seal includes a depending skirt portion which contacts and slides along the bore wall, and wherein the second seal is an O-ring.

5. The sprinkler defined in claim 3, wherein the housing is an elongated upright body with upper and lower ends, the water inlet passage having an inlet fitting for connection to a water-supply line, the inlet fitting being positioned approximately midway between the housing ends.

6. The sprinkler defined in claim 5, wherein the inlet fitting includes a freely rotatable union nut.

7. The sprinkler defined in claim 6, and further comprising a resilient seal disposed in the union nut, the seal having a portion defining a trap to prevent entry into the sprinkler of coarse particulates in the line water.

8. The sprinkler defined in claim 3, wherein the resilient means is a coil spring having first and second ends, the first end being connected to the upper end of the riser, and further comprising a keeper disposed in the housing below the riser and adapted for attachment to the second end of the spring, the keeper being configured to limit retraction movement of the riser so the upper end of the riser extends above the wiper means when the riser is in the retracted position.

9. An irrigation sprinkler, comprising:

a housing having a water inlet passage and an internal wall defining an elongated bore connected to the inlet passage;

a riser having upper and lower ends, and a flow passage extending between the ends, the upper end being adapted to receive a sprinkler head, the riser making a loose slip fit in the housing bore to be movable between extended and retracted positions;

a cup seal mounted on the riser adjacent the lower end of the riser, and serving substantially to seal an annulus between the riser and housing bore wall against entry of line-pressure water introduced into the inlet passage, whereby flow of line-pressure water from the inlet passage is confined to the bore beneath the seal and to the riser flow passage; and resilient means connected between the housing and riser to urge the riser into the retracted position when line-pressure water is not flowing through the sprinkler.

10. The sprinkler defined in claim 9, and further comprising a wiper means mounted on the housing around the riser for wiping debris from the riser as the riser is moved from the extended position to the retracted position.

* * * * *